US005337712A

United States Patent [19]

Reitz

[11] Patent Number: 5,337,712

[45] Date of Patent: Aug. 16, 1994

[54] VALVE GEAR FOR AT LEAST TWO SIMULTANEOUSLY OPERATED VALVES

[75] Inventor: Dieter Reitz, Muhltal, Fed. Rep. of Germany

[73] Assignee: General Motors Corporation, Detroit, Mich.

[21] Appl. No.: 76,177

[22] Filed: Jun. 11, 1993

[30] Foreign Application Priority Data

Aug. 13, 1992 [DE] Fed. Rep. of Germany ..... 4226760

[51] Int. Cl.[5] ..... F01L 1/26

[52] U.S. Cl. ..... 123/90.22

[58] Field of Search ..... 123/90.22, 90.23, 90.27

[56] References Cited

U.S. PATENT DOCUMENTS

| | | | |
|---|---|---|---|
| 1,639,874 | 8/1927 | Woolson | 123/90.22 |
| 3,963,004 | 6/1976 | Lysinger et al. | 123/90.22 |
| 4,658,780 | 4/1987 | Hosoi | 123/90.22 |
| 4,805,567 | 2/1989 | Heimburg | 123/90.22 |
| 5,184,580 | 2/1993 | Ascari | 123/90.22 |

FOREIGN PATENT DOCUMENTS

| | | |
|---|---|---|
| 3344324 | 6/1985 | Fed. Rep. of Germany . |
| 4039075 | 4/1992 | Fed. Rep. of Germany . |

*Primary Examiner*—Raymond A. Nelli
*Assistant Examiner*—Weilun Lo
*Attorney, Agent, or Firm*—Charles K. Veenstra

[57] ABSTRACT

To operate several overhead valves 5, 6 of an internal combustion engine simultaneously via a cam 18 using standard commercial cup tappets 7, 8, a crossbar 14 is placed over the bases of the cup tappets 7, 8. The crossbar is acted on between the axes of the valves 5, 6, either directly by the cam 18 or via a rocker arm. The crossbar 14 is secured against displacement by a contour 16 projecting between the cup tappets.

1 Claim, 2 Drawing Sheets

VALVE GEAR FOR AT LEAST TWO SIMULTANEOUSLY OPERATED VALVES

TECHNICAL FIELD

The invention pertains to valve gear or actuating mechanism for at least two simultaneously operated overhead valves for a cylinder of an internal combustion engine.

BACKGROUND

DE 40 39 075 describes valve gear of this type, in which a cup tappet is provided in the cylinder head for the valves that are to be operated together. The cup tappet contains a valve lash adjusting element for each of the associated valves. The valve lash adjusting elements are hydraulically connected with each other through bores and are supplied from a central hydraulic fluid chamber.

A cup tappet of this type, extending over several valves, is very expensive to produce. Ready-made parts cannot be used. Due to space limitations, it is also not practical to design a cup tappet of this type with a circular shape. Instead, it is necessary to resort to an oval form of design, which makes it more expensive to produce both the cylinder head and the valve tappet.

Another known valve of the specified type is described in DE-OS 33 44 324, in which, for the purpose of reducing the dimensions for several valves, a common, yoke-like valve tappet is proposed, which is acted upon by a restoring spring common to the valves that encloses their shafts. To guide this valve tappet, a special bolt or stud is provided in the cylinder head. Once again, this requires added production cost for both the valve tappet and the cylinder head. With a design of this type, it is not possible to use standardized cup tappets, so that the production expense of such a valve drive is greatly increased. Furthermore, the valve spring common to several valves obstructs the space that is necessary, for example, for the injection nozzle in a diesel engine with direct injection, so that this valve drive cannot be used in every type of internal combustion engine.

SUMMARY OF THE INVENTION

A goal of the invention was to create a valve drive of the type described at the beginning, in which the greatest possible use of standardized parts could be made and which would leave enough space free for an injection nozzle or the like to be mounted centrally of the cylinder.

In accordance with the invention, this goal is achieved by providing for each valve of the simultaneously operated valve group its own cup tappet and its own valve spring and by providing a common crossbar, which rests on the base of the cup tappets, which is secured against displacement, and on the side which faces away from the cup tappets a cam of a camshaft acts between the valve axes.

The crossbar is preferably designed in such a way that it has flat contact surfaces that rest against the flat bases of the cup tappets and that it has a contour extending beyond the plane of the contact surfaces, which engages between the outer circumferences of the cup tappets.

The cam can act directly on the crossbar, if the camshaft is placed above the upper valves; however, it can also act on the crossbar via a rocker arm, if the camshaft is laterally mounted, next to the upper valves.

In valve gear of this type, commercial cup tappets can be used with standard hydraulic valve clearance adjusting elements and commercial valve springs. The crossbar lying above the cup tappets can be easily shaped in such a way that enough space is left for mounting a central injection nozzle or the like. It was found that the crossbar only has to be secured against lateral displacement on the cup tappets. Tipping or turning of the crossbar on the cup tappets, e.g., due to shifting of the cam contact line, does not occur when the engine is running. Surprisingly, therefore, there is no need for any type of guidance of the crossbar in the direction of operation. Since the cylinder head thus needs to be provided only with the usual circular guides for the cup tappets, since the cup tappets themselves and the valve springs can be taken from already available large production runs, and since the crossbars can be very easily produced, the valve drive of the invention is also very economical.

BRIEF DRAWING DESCRIPTION

A specific embodiment of the invention is described in greater detail below with reference to the drawings.

DETAILED DESCRIPTION

Figure 1:
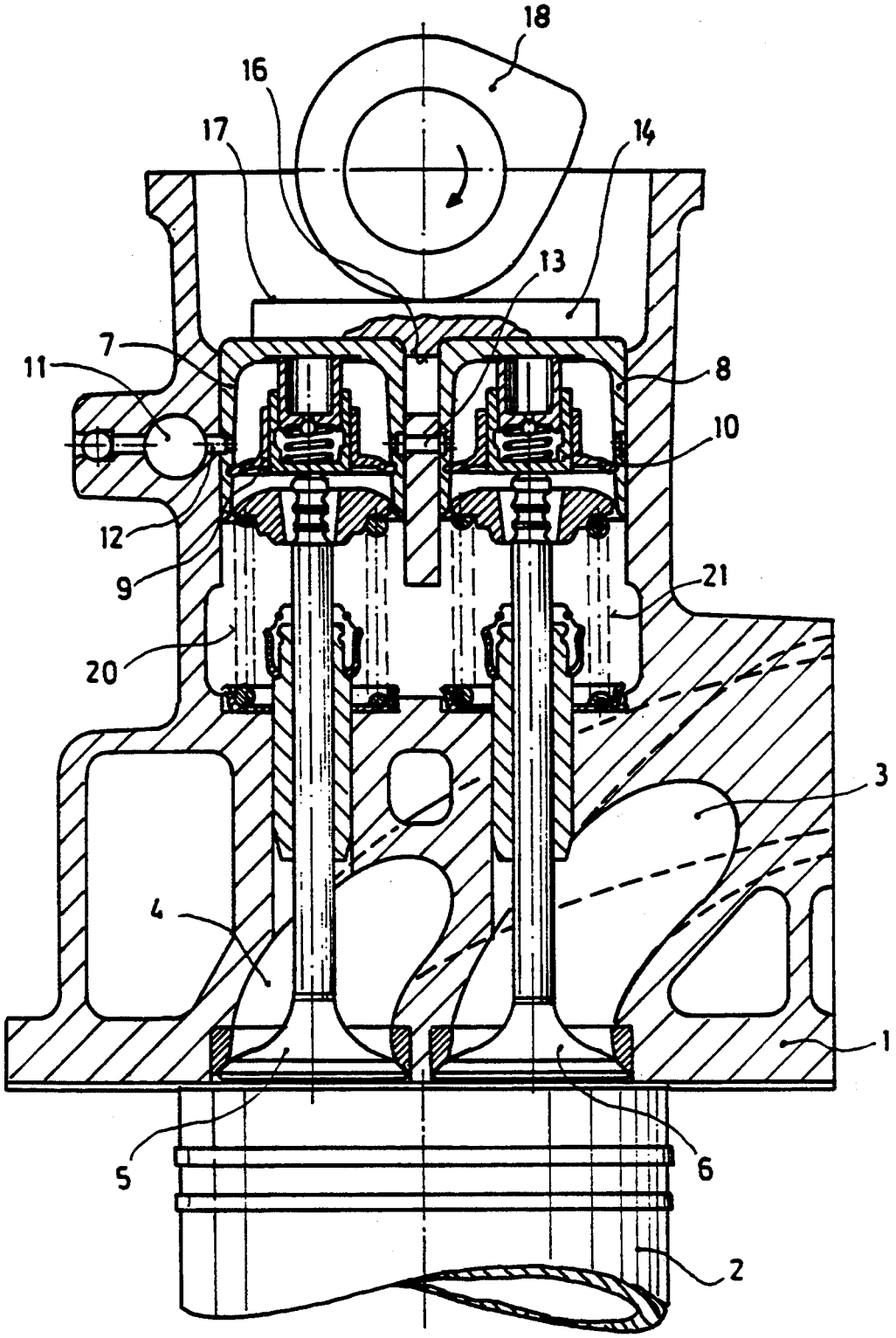
FIG. 1 shows a cross section of an engine having valve gear according to the invention.
Figure 2:
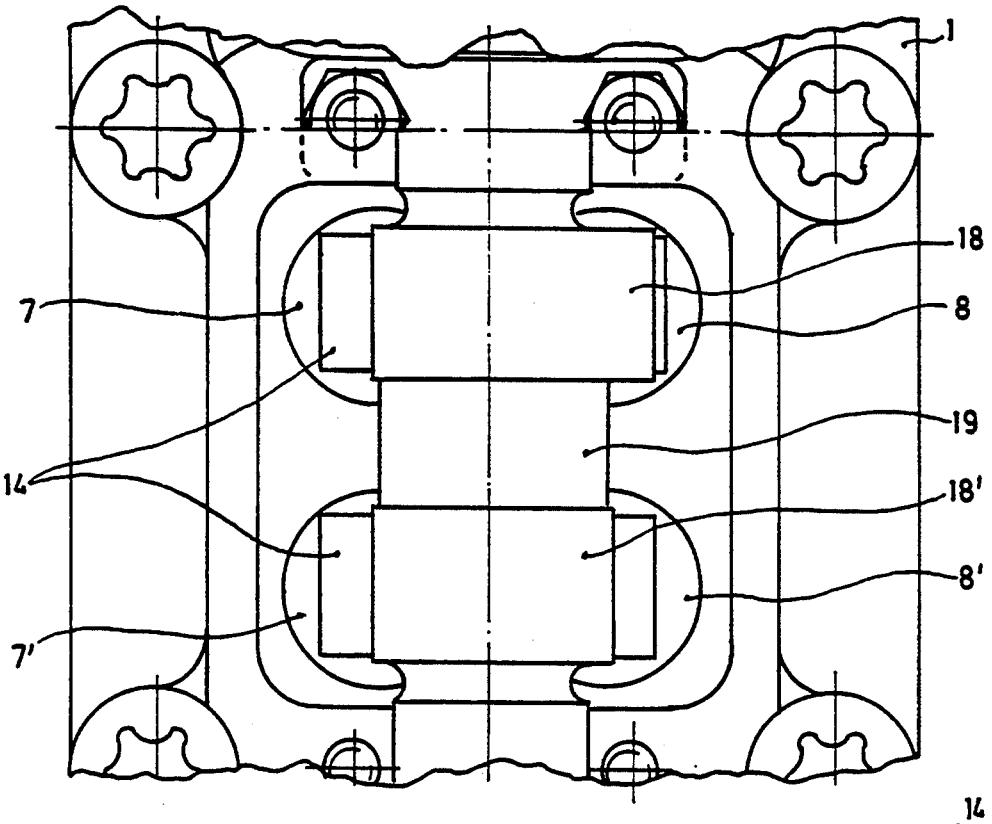
FIG. 2 shows a top view of the valve gear in FIG. 1.
Figure 3:
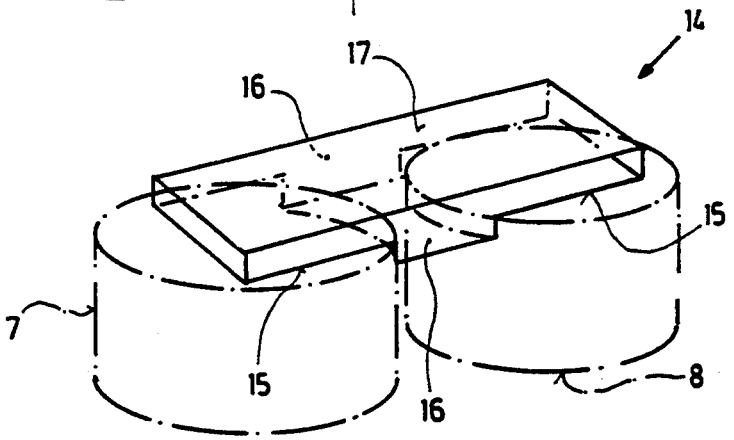
FIG. 3 shows a crossbar of the valve gear in FIG. 1, resting on two cup tappets, in a perspective view.

A cylinder head 1 of an internal combustion engine is mounted on a cylinder block (not shown), in which a reciprocating piston 2 moves inside a cylinder and seal a working chamber of variable volume. Gas-exchange passages lead to the working chamber, namely, intake passages 3, 4 and exhaust passages (not shown). The intake passages 3, 4 are closed or opened by two overhead valves 5, 6. The exhaust passages (not shown) are likewise operated by two overhead valves. Each of the overhead valves 5, 6 is associated with a cup tappet 7, 8 or 7', 8', in which a hydraulically acting adjusting element 9, 10 is provided for adjustment of the valve lash in known manner. Oil is supplied to the adjusting elements 9, 10 by an oil passage 11 in the cylinder head 1 through boreholes 12, 13. A crossbar 14 lies above the cup tappets 7, 8 of the two valves 5, 6 that control the intake passages 3, 4 and above the cup tappets 7', 8' that control the overhead valves (not shown) of the exhaust passages. Each of the crossbars 14 lies with its flat contact surfaces 15 on the bases of the simultaneously operated cup tappets 7 and 8 or 7' 8'. Between the contact surfaces 15 of each crossbar 14 there is a projecting contour 16, which extends between the cup tappets 7, 8 or 7', 8' that are acted on by the given crossbar 14. The side of the crossbars 14 facing away from the cup tappets 7, 8; 7', 8' forms a continuous flat surface 17, on which a cam 18 of a camshaft 19 acts. Valve springs 20, 21, which bring the upper valves 5, 6 into the closed position, keep the valves 5, 6, the corresponding cup tappets 7, 8 and the crossbar 14 lying on them in operating connection with the control cam 18.

Figure 4:
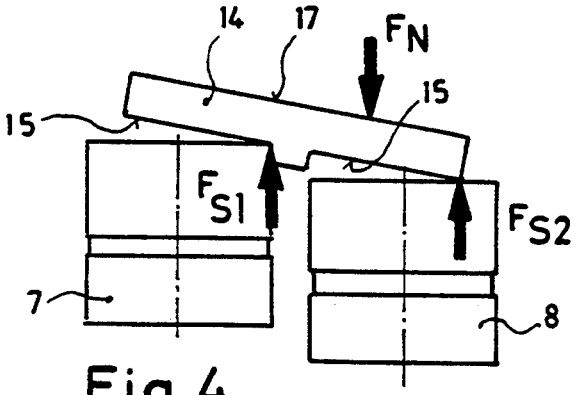
FIG. 4 is a schematic representation of the forces acting on the crossbar during operation of the engine.

During operation of the internal combustion engine, the cam 18, 18' of the camshaft 19 pushes on the surface 17 of the crossbar 14. The crossbar 14 transmits the motion from the cam 18, 18' to the cup tappets 7, 8 or 7', 8', from which it is transmitted to the valves 5, 6 via the adjusting elements 9, 10 in known manner. The contact surfaces 15 of the crossbars 14 remain in full contact with the flat bases of the cup tappets 7, 8 or 7', 8' during this process. Tipping of the crossbars, as shown in FIG. 4, cannot occur, since the closing forces $F_{S1}$ and $F_{S2}$ applied by the valve springs 20, 21, in conjunction with the geometry of the cup tappets 7, 8 and the crossbar 14, always act in such a way that a reliable equilibrium is always maintained, even in the case of a functionally related lateral shift of the point of application of the cam force $F_N$ of the cam 18. The stable position of the crossbar 14 on the cup tappets 7, 8 is maintained even if the closing forces $F_{S1}$ and $F_{S2}$ should differ due to differences in frictional forces.

Figure 5:
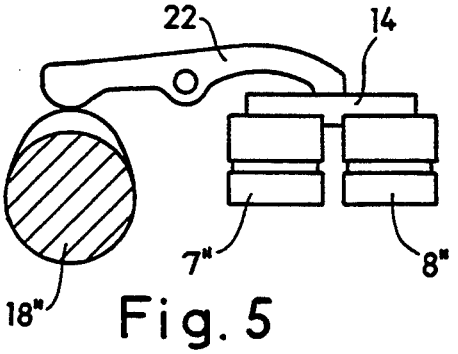
FIG. 5 is a side view showing an alternative embodiment of the invention.

Naturally, the invention can also be used in internal combustion engines with three valves per cylinder by providing, for example, one crossbar for only two intake valves, while the exhaust valve is acted upon directly by the cam in the usual way. It is also possible to use the invention in internal combustion engines with more than four valves per cylinder by laying a crossbar over a group of three or more cup tappets and the associated valves, which are then operated by the action of a cam on the crossbar. The cam can also act on the crossbar via a rocker arm, so that the camshaft can be arranged on the side, next to the overhead valves. Such an arrangement is shown in FIG. 5 where the cam 18'' actuates a rocker arm 22 which acts against the crossbar 14 to operate the cup tappets 7'', 8'' in the manner previously described.

It is thus possible, with the use of simple means and commercially available cup tappets, which can also be equipped with hydraulic adjusting elements, to realize multiple-valve operation with one cam. An internal combustion engine with three, four or more valves per cylinder can thus be produced relatively inexpensively.

The invention is not intended to be limited to the specific embodiment described, but should be given the full scope permitted by the language of the following claims.

What is claimed is:

1. Valve gear for a group of at least two simultaneously operated overhead valves for a cylinder of an internal combustion engine, wherein each valve (5, 6) of the simultaneously operated valve group is associated with its own cup tappet (7, 8; 7', 8') and its own valve spring (20, 21) and a common crossbar (14) rests on bases of these cup tappets (7, 8; 7' 8'), the crossbar (14) having a surface (17) facing away from the cup tappets (7, 8; 7' 8') on which a cam (18, 18') of a camshaft (19) acts between the valve axes, wherein flat contact surfaces (15) of the crossbar (14) rest on flat bases of the cup tappets (7, 8; 7', 8') and a contour (16) extending beyond the plane of the surfaces (15) extends between the outer circumferences of the cup tappets (7, 8; 7', 8'), and wherein the crossbar is not otherwise secured to the cup tappets.

* * * * *